US012016410B2

(12) United States Patent
Boyd et al.

(10) Patent No.: US 12,016,410 B2
(45) **Date of Patent: *Jun. 25, 2024**

(54) SECURE POCKET STRUCTURE

(71) Applicant: NIKE, Inc., Beaverton, OR (US)

(72) Inventors: Patrick D. Boyd, Aloha, OR (US); Amanda Tindell, Beaverton, OR (US); Mark A. Van Weerd, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/126,627

(22) Filed: Mar. 27, 2023

(65) Prior Publication Data

US 2023/0301382 A1 Sep. 28, 2023

Related U.S. Application Data

(63) Continuation of application No. 17/371,298, filed on Jul. 9, 2021, now Pat. No. 11,641,898, which is a (Continued)

(51) Int. Cl.
*A41D 27/20* (2006.01)

(52) U.S. Cl.
CPC ..... *A41D 27/205* (2013.01); *A41D 27/201* (2013.01); *A41D 27/207* (2013.01); *A41D 2300/22* (2013.01)

(58) Field of Classification Search
CPC .... A41D 27/205; A41D 27/207; A41D 27/20; A41D 27/204; A41D 13/0012; (Continued)

(56) References Cited

U.S. PATENT DOCUMENTS 198,753 A 1/1878 Perry
666,289 A 1/1901 Vineberg
(Continued)

FOREIGN PATENT DOCUMENTS

CN 103169182 A 6/2013
CN 203767253 U 8/2014
(Continued)

OTHER PUBLICATIONS

English translation of JP 3164165 (Doc Pub. Nov. 2010). Translation obtained from https://www.j-platpat.inpit.go.jp.*
(Continued)

*Primary Examiner* — Amy Vanatta
(74) *Attorney, Agent, or Firm* — Shook, Hardy & Bacon L.L.P.

(57) ABSTRACT

Aspects herein are directed to a pocket structure that facilitates the secure storage of items stowed within the pocket structure. The pocket structure includes inner and outer pocket layers defining a pocket space therebetween. The pocket structure further includes a first tapered channel structure positioned in the pocket space between the outer pocket layer and the inner pocket layer, that has an inlet opening and an outlet opening opposite the inlet opening. The first tapered channel structure providing a passageway to the pocket space from the inlet opening edge to the outlet opening edge; and a first tether structure extending from the tapered channel structure to one or more of the outer pocket layer, the inner pocket layer, and a seam joining the outer pocket layer and the inner pocket layer.

18 Claims, 8 Drawing Sheets

Related U.S. Application Data continuation of application No. 16/438,758, filed on Jun. 12, 2019, now Pat. No. 11,089,828.

(60) Provisional application No. 62/703,261, filed on Jul. 25, 2018.

(58) Field of Classification Search
CPC .. A41D 27/201; A41D 2300/22; A41D 1/002; A41D 1/02; A41D 1/06; A41D 1/08–1/089; A41D 1/14; A41D 27/208; A41D 1/04; A41D 3/02; A41D 1/18; A41B 1/00; A41B 1/08
USPC ..... 2/254, 250, 94
See application file for complete search history.

(56) References Cited

U.S. PATENT DOCUMENTS

| | | | | |
|---|---|---|---|---|
| 825,189 | A | 7/1906 | Clark et al. | |
| 844,539 | A * | 2/1907 | Rosenquist | A41D 27/20 2/254 |
| 853,068 | A | 5/1907 | Dean | |
| 934,660 | A | 9/1909 | Dean | |
| 1,036,054 | A | 8/1912 | Abrahams | |
| 1,116,643 | A * | 11/1914 | Strobel | A41D 27/20 2/254 |
| 1,256,787 | A | 2/1918 | Grant | |
| 1,431,275 | A | 10/1922 | Wood | |
| 1,466,993 | A * | 9/1923 | Creech, Jr. | A41B 15/02 40/538 |
| 1,496,330 | A | 6/1924 | Tollefson | |
| 1,522,664 | A | 1/1925 | Wood | |
| 1,649,636 | A | 11/1927 | Wood | |
| 1,725,306 | A | 8/1929 | Nathan | |
| 1,769,062 | A | 7/1930 | King | |
| 1,786,879 | A | 12/1930 | Louis | |
| 2,421,695 | A | 6/1947 | Henson | |
| 2,642,576 | A | 6/1953 | Emanuel | |
| 4,791,681 | A | 12/1988 | Dean | |
| 5,421,032 | A | 6/1995 | Murphy | |
| 5,771,496 | A | 6/1998 | Wood | |
| 6,131,205 | A | 10/2000 | Arem | |
| 6,374,421 | B1 | 4/2002 | Cleary | |
| D659,350 | S | 5/2012 | Mcdonnell | |
| 8,402,562 | B1 | 3/2013 | Seddiki | |
| 9,060,555 | B1 | 6/2015 | Harris et al. | |
| 2009/0172861 | A1 | 7/2009 | Tomlinson et al. | |
| 2013/0000010 | A1 | 1/2013 | Ryan | |
| 2013/0219581 | A1 | 8/2013 | Schrimpf | |
| 2015/0074871 | A1 | 3/2015 | Emich et al. | |
| 2016/0324236 | A1 | 11/2016 | Schrimpf | |
| 2017/0258158 | A1 | 9/2017 | Baiany | |
| 2017/0354192 | A1 | 12/2017 | Albano et al. | |
| 2019/0000167 | A1 | 1/2019 | Kuang | |
| 2020/0029637 | A1 | 1/2020 | Boyd et al. | |
| 2020/0128894 | A1 | 4/2020 | Kloosterman | |
| 2021/0330008 | A1 | 10/2021 | Boyd et al. | |
| 2022/0132958 | A1 | 5/2022 | Losgar | |
| 2022/0232916 | A1 | 7/2022 | Tuffery et al. | |

FOREIGN PATENT DOCUMENTS

| | | | |
|---|---|---|---|
| CN | 110384271 | A | 10/2019 |
| DE | 19624909 | C1 | 11/1997 |
| DE | 202014002960 | U1 | 8/2014 |
| DE | 202014002963.6 | U1 | 8/2014 |
| JP | 2002-105725 | A | 4/2002 |
| JP | 2002-363812 | A | 12/2002 |
| JP | 2007-016323 | A | 1/2007 |
| JP | 3164165 | U | 11/2010 |
| KR | 10-1264045 | B1 | 5/2013 |
| WO | 2014/038740 | A1 | 3/2014 |

OTHER PUBLICATIONS

English translation of JP 3164165 (Doc Pub. Nov. 2010). Translation obtained from Patent Translate powered by EPO and Google.*
English language machine translation of JP 2007016323 (Pub Jan. 2007), Espacenet; 6 pages.
Extended European Search Report and Search Opinion received for European Application No. 23203367.0 dated Jan. 5, 2024, 6 pages.
International Preliminary Report on Patentability received for PCT Patent Application No. PCT/US2019/038276 dated Feb. 4, 2021, 9 pages.
International Search Report and Written Opinion dated Sep. 30, 2019 in International Patent Application No. PCT/US2019/038276, 18 pages.
Non-Final Office Action received for U.S. Appl. No. 17/371,297, dated Sep. 15, 2022, 15 pages.
Non-Final Office Action received for U.S. Appl. No. 17/371,298, dated Sep. 15, 2022, 13 pages.
Notice of Allowance received for U.S. Appl. No. 17/371,294, dated Sep. 15, 2022, 9 pages.
Notice of Allowance received for U.S. Appl. No. 17/371,297, dated Jan. 5, 2023, 11 pages.
Notice of Allowance received for U.S. Appl. No. 17/371,298, dated Jan. 5, 2023, 9 pages.
Office Action received for Canadian Patent Application No. 3,106,810, dated Mar. 17, 2022, 5 pages.
Office Action received for Canadian Patent Application No. 3,106,810, dated Oct. 11, 2022, 4 pages.
Office Action received for European Application No. 19737379.8, dated Dec. 13, 2023, 4 pages.
Office Action received for European Application No. 19737379.8, dated Jan. 24, 2023, 5 pages.
European search report received for European Application No. 23203365.4, dated Jan. 5, 2024, 6 pages.

* cited by examiner

SECURE POCKET STRUCTURE

CROSS-REFERENCE TO RELATED APPLICATIONS

This application is a continuation application of U.S. application Ser. No. 17/371,298, filed Jul. 9, 2021, and titled "Secure Pocket Structure," which is a continuation application of U.S. application Ser. No. 16/438,758, filed Jun. 12, 2019, and titled "Secure Pocket Structure," which claims the benefit of priority of U.S. Prov. App. No. 62/703,261, filed Jul. 25, 2018, and titled "Secure Pocket Structure." The entireties of the aforementioned applications are incorporated by reference herein.

TECHNICAL FIELD

Aspects herein relate to a pocket structure for an article that provides secure storage of items within the pocket structure.

BACKGROUND

Traditional pockets may not be secure in that items stowed within the pocket may inadvertently fall out of the pocket. Moreover, use of hardware such as zippers or snaps to help secure items within a pocket may add manufacturing costs to the production of the article, make the pocket more difficult to open, increase the weight of the pocket, and introduce unnecessary stress points where the hardware attaches to the textile forming the pocket. Further, buttons can fall off, zippers can jam and fail, and for those with limited manual dexterity, zippers, buttons, snaps and other such fasteners may be difficult to operate. For instance, zippers may require two hands to operate—one hand to pull the zipper pull, and the other hand to maintain tension on the zipper tape. This may cause problems when at least one of the wearer's hands is otherwise engaged such as when holding a child, a bag of groceries, or some other item.

DESCRIPTION OF THE DRAWINGS

Examples of aspects herein are described in detail below with reference to the attached drawings figures, wherein.

DETAILED DESCRIPTION

Figure 1:
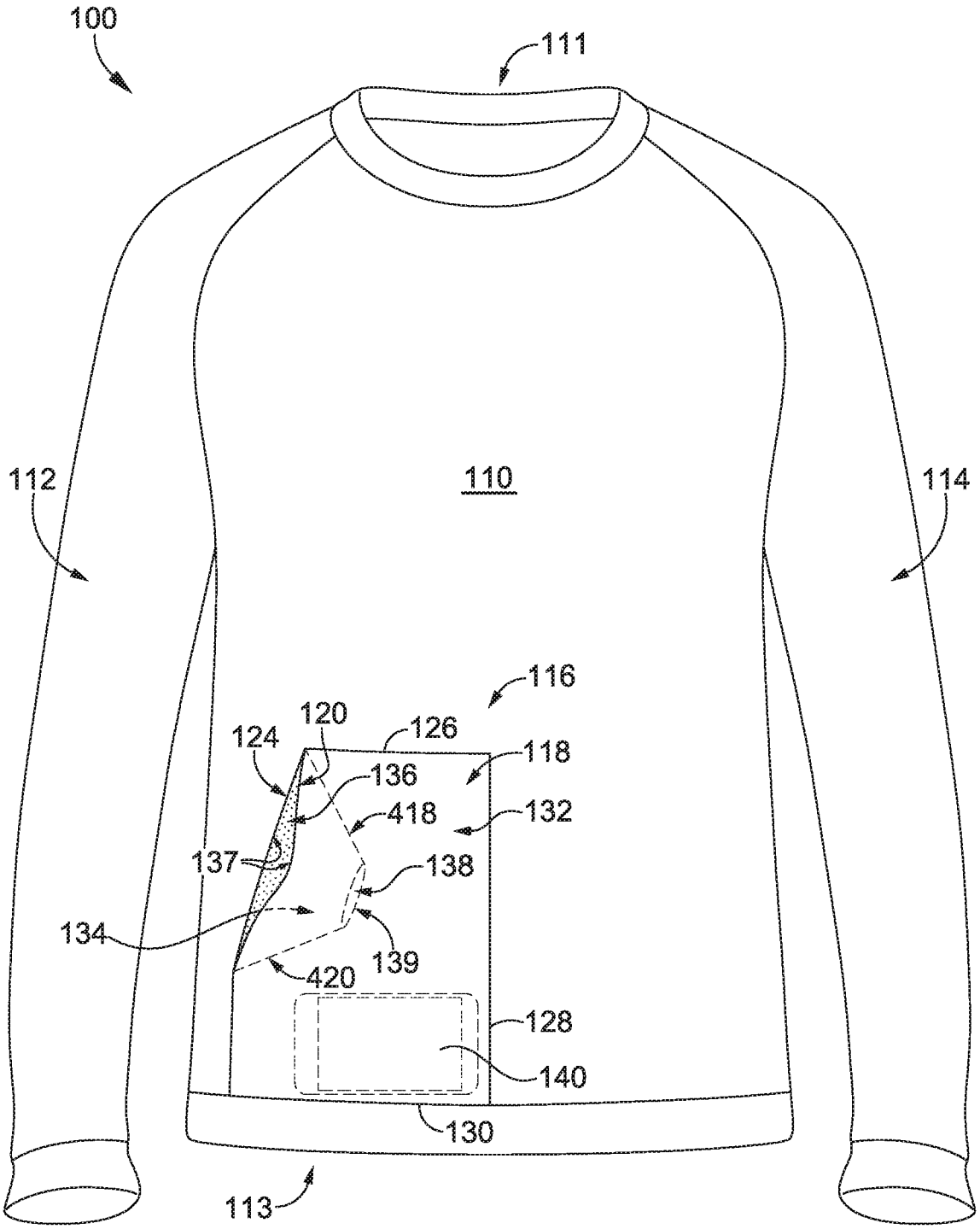
FIG. 1 illustrates a front view of an upper-body garment having a pocket structure in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to a pocket structure that helps to secure items stowed within the pocket. In one aspect, the pocket structure comprises a pocket having inner and outer pocket layers that define a space between the two layers. The pocket structure additionally comprises a funnel-shaped structure positioned in the space between the inner and outer pocket layers. The funnel-shaped structure comprises an inlet opening defined by an inlet opening edge where the inlet opening forms the opening to the pocket structure. The funnel-shaped structure further comprises an outlet opening defined by an outlet opening edge where the outlet opening is positioned a predetermined distance inwardly from the inlet opening and where the outlet opening is in communication with the space formed between the inner and outer pocket layers. In example aspects, the inlet opening has a wider diameter and/or circumference than the outlet opening. Thus, when a wearer wishes to stow an item within the pocket, the wearer can pass the item through the wider inlet opening of the funnel-shaped structure and subsequently pass the item through the smaller outlet opening of the funnel-shaped structure; the item is then positioned in the space between the inner and outer pocket layers. Because of the small circumference of the outlet opening, and because the funnel-shaped structure is generally free floating within the space between the inner and outer pocket layers, the item is more likely to move into the spaces between the front of the funnel-shaped structure and the outer pocket layer or between the back of the funnel-shaped structure and the inner pocket layer than to re-enter the small-diameter outlet opening absent a purposeful removal of the item by the wearer. The structure described herein is somewhat akin in concept to bottle traps used in fishing.

To retrieve the item from the pocket, the wearer passes her hand through the outlet opening and grasps the item before withdrawing her hand from the outlet opening and subsequently through the inlet opening. In an example aspect, the funnel-shaped structure may be tethered in such a way as to prevent the funnel-shaped structure from everting when the wearer's hand is withdrawn from the pocket with, for instance, the item. One tether structure may comprise a cord, band, or strap that extends inwardly from the outlet opening of the funnel-shaped structure, or an area adjacent the outlet opening, to the inner or outer pocket layer, or a seam line connecting the inner and outer pocket layers. Another tether structure comprises one or more pieces of a thin, pliable material that extend from edges of the funnel-shaped structure to the inner or outer pocket layer, or a seam line connecting the inner and outer pocket layers. Still yet another tether structure may comprise one or more stitches that affix a small area of the funnel-shaped structure to the inner or outer pocket layers.

In still further example aspects, the funnel-shaped structure and/or the inner and outer pocket layers may be formed from an elastically resilient material to help the pocket structure lay flat, thus improving the aesthetics of the pocket structure, ensuring the pocket structure has a low profile, and further facilitating the security of items stowed within the pocket structure. As well, aspects herein contemplate that the outlet opening may be circumscribed by an elastic band or elastic material to further reduce the circumference of the outlet opening and to further help secure items stowed within the pocket structure. The configuration described above helps to provide secure stowage of items within the pocket without use of hardware such as zippers, snaps, buttons, and the like which may increase manufacturing costs, increase the weight of the article, and/or introduce unnecessary stress points where the hardware attaches to the pocket structure and/or article. As well, the configuration as described also facilitates ease of use in that a wearer can stow and retrieve items using one hand due to use of, for instance, the tether structure(s).

Positional terms as used herein such as "inner," "outer" "medial," "lateral," "upper," "lower," "superior," "inferior," and the like are with respect to, for instance, a garment being in an as-worn configuration by a hypothetical wearer standing upright and wearing the garment as intended and as shown and described herein. With respect to the terms "inner" and "outer" when used in relation to a garment, the term "inner" means closer to a wearer's body when the garment is worn, while the term "outer" means further away from the wearer's body relative to a corresponding "inner" structure. When the positional terms are used with respect to an article, such as, for example, a duffel bag or a backpack, the terms are used with respect to the article being in an as-worn configuration or in an as-positioned configuration.

The term "edge" as used herein when referring to, for instance, an opening edge of a pocket or an edge of the funnel-shaped structure may refer to a free edge of a textile or material (i.e., an edge of a textile that is not joined to another textile) or it may refer to a general line of demarcation denoting the outside limit or border of the pocket or funnel-shaped structure. In one example, the term "inner opening edge" may mean the demarcation line on an article that is defined by where the outer opening edge is positioned.

The term "article" as used herein may mean a garment such as an upper-body garment (e.g., a shirt, a jacket, a coat, a support garment, and the like), a lower-body garment (e.g., shorts, pants, and the like), or a combination upper-body garment and lower-body garment (e.g., a unitard, overall, and the like) as well as articles such as bags, backpacks, duffel bags, totes, and the like. The term "elastically resilient" as used herein refers to a textile (knit, woven, non-woven, braided, and the like) that has stretch and recovery properties along at least one axis through, for instance, the use of elastic yarns.

Continuing, the term "tether" as used herein refers generally to a structure that restricts movement of another structure, such as, for example, the funnel-shaped structure described herein. The term "integrally extends" as used herein means a textile having at least one textile element (e.g., yarn, filament, or fiber) that extends between different areas of a textile. For instance, with respect to the outer and inner opening edges of the outer and inner pocket layers and the inlet opening edges of the funnel-shaped structure, the inlet opening edges of the funnel-shaped structure may be said to integrally extend from the outer and inner opening edges if there is at least one textile element that extends from the body of the inner and/or outer pocket layers to the body of the funnel-shaped structure. To describe this differently, in one example aspect, the inner and/or outer pocket layers and the funnel-shaped structure may be formed during a single knitting, braiding, manufacturing, and/or weaving event.

When referring specifically to the funnel-shaped structure described herein, the term "deformed" means that the funnel-shaped structure is artificially deformed or manipulated into a generally conical shape having a generally circular inlet opening and a generally circular outlet opening. Describing the funnel-shaped structure in a "deformed" state may help to better illustrate features of the funnel-shaped structure such as its diameter, circumference, and the like. The term "expanded" as used herein when describing the funnel-shaped structure is with respect to the funnel-shaped structure being positioned within a pocket structure on an article in a generally flattened state and reversibly expanding when an item (e.g., a wearer's hand, a wearer's hand carrying an item, an item) is passed through the funnel-shaped structure. Once the wearer's hand is removed, the funnel-shaped structure generally returns to its resting, "flattened" state.

Turning now to FIG. 1, a front view of an example article in the form of an upper-body garment 100 is shown in accordance with aspects herein. The garment 100 is shown in the form of a pullover shirt having a torso portion 110 with a front aspect (shown) configured to cover a front torso of a wearer and a back aspect (not shown in the view) configured to cover a back torso area of a wearer. The torso portion 110 defines a neck opening 111 configured to encircle a wearer's neck and a waist opening 113 configured to encircle a wearer's waist. The garment 100 further comprises a first sleeve 112 extending from the torso portion 110 and configured to cover, at least partially, a wearer's arm, and a second sleeve 114 extending from the torso portion 110 and configured to cover, at least partially, the wearer's other arm. Although not shown, it is contemplated herein that a hood may extend from the neck opening 111 where the hood is configured to cover, at least partially, a wearer's head. The depiction of the garment 100 is illustrative only, and it is contemplated herein that the garment 100 may take other forms such as a jacket, a coat, a short-sleeved shirt, a vest, a hoodie, and the like.

The garment 100 includes a pocket structure 116 positioned on a lower, front aspect of the torso portion 110. The location of the pocket structure 116 is illustrative only, and it is contemplated herein that the pocket structure 116 may be positioned at other locations on the garment 100 such as the back aspect of the torso portion 110, side aspects of the torso portion 110, the first sleeve 112, the second sleeve 114, and/or other locations on the front aspect of the torso portion 110. Further, although only one pocket structure 116 is shown, it is contemplated herein that the garment 100 may comprise multiple pocket structures positioned at one or more different locations on the garment 100. Moreover, the square shape shown for the pocket structure 116 is illustrative only, and it is contemplated herein that the pocket structure 116 may assume other shape configurations (circular, rectangular, and the like). Any and all aspects, and any variation thereof, are contemplated as being within aspects herein.

In example aspects, the pocket structure 116 includes an outer pocket layer 118 having an outer opening edge 120 and an inner pocket layer (not visible) having an inner opening edge 124 where the outer pocket layer 118 is positioned adjacent and external to the inner pocket layer to define a space 132 therebetween. In example aspects, the inner pocket layer may comprise an integral extension of the material used to form, for instance, the torso portion 110 of the garment 100. It is contemplated herein, that one or more of the outer pocket layer 118 and the inner pocket layer may be formed from a knit, woven, or non-woven material that is elastically resilient along at least one axis although use of non-elastic materials is also contemplated herein. Use of an elastically resilient material to form the outer pocket layer 118 and/or the inner pocket layer may facilitate the expansion of the pocket structure 116 upon entry of, for instance, a wearer's hand, and the contraction of the pocket structure 116 when the wearer's hand is withdrawn. The result is that the pocket structure 116 generally lies flat when not in use thereby facilitating the security of items stowed within the pocket structure 116. It is further contemplated herein, that the material used to form the outer pocket layer 118 and/or the inner pocket layer may also be used to form other portions of the garment 100.

In the aspect shown in FIG. 1, the pocket structure 116 is located on an exterior aspect of the garment 100, and the outer opening edge 120 comprises a free edge and the inner opening edge 124 comprises an outermost boundary of the pocket structure 116 though it may not necessarily comprise a free edge. To describe it differently, in the aspect shown in FIG. 1, the inner opening edge 124 may comprise an artificial demarcation line on the garment 100 that is defined by where the outer opening edge 120 is positioned when the pocket structure 116 is in a relaxed, non-deformed state. In an example aspect where the pocket structure 116 is located on an interior aspect of the garment 100, the inner opening edge 124 may comprise a free edge and the outer opening edge 120 may comprise an artificial demarcation line on the garment 100 that is defined by where the inner opening edge 124 is positioned. Continuing with respect to the aspect shown in FIG. 1, in some example aspects, the outer pocket layer 118 may comprise one or more additional edges that are affixed to the inner pocket layer and/or the garment 100 to define an upper edge 126 of the pocket structure 116, a rear edge 128 and a lower edge 130 of the pocket structure 116.

The pocket structure 116 additionally comprises a funnel-shaped structure 134 that is shown in dashed line to indicate it is generally hidden from view by the outer pocket layer 118. It is contemplated herein that the funnel-shaped structure 134 may be formed of a knit, woven, or non-woven material that is elastically resilient along at least one axis although aspects herein contemplate that the funnel-shaped structure 134 may be formed of a non-elastic material. Use of an elastically resilient material facilitates the expansion of the funnel-shaped structure 134 upon entry of, for instance, a wearer's hand, and the contraction of the funnel-shaped structure 134 when the wearer's hand is withdrawn so that the funnel-shaped structure 134 lies flat when not in use. It is further contemplated herein, that the material used to form the funnel-shaped structure 134 may comprise a lightweight, pliable material. Any and all aspects, and any variation thereof, are contemplated as being within aspects herein.

As will be explained in greater detail below, the funnel-shaped structure 134 comprises an inlet opening 136 defined by an inlet opening edge 137 that is joined to or extends from the outer opening edge 120 and the inner opening edge 124. In one example aspect, the inlet opening edge 137 may integrally extend from the outer opening edge 120 and the inner opening edge 124. Because of this construction, the inlet opening 136 forms the opening to the pocket structure 116. The funnel-shaped structure 134 further comprises an outlet opening 138 defined by an outlet opening edge 139 where the outlet opening 138 is in communication with the space 132 formed between the outer pocket layer 118 and the inner pocket layer. Although the funnel-shaped structure 134 is generally in a flattened state when present in an article such as the garment 100, it is contemplated herein that the inlet opening 136 and the outlet opening 138 may be deformed from the flattened state to form a generally circular shape each having a center, a circumference, and a diameter. And when the term "diameter" is used herein, it is with respect to the inlet opening 136 and the outlet opening 138 having a circle shape as opposed to a flattened state. This aspect is discussed in greater detail with respect to FIGS. 2-4.

Continuing, in example aspects, the diameter and/or the circumference of the outlet opening 138 may be less than the diameter and/or the circumference of the inlet opening 136. For instance, the diameter of the outlet opening 138 may be about three-quarters the diameter of the inlet opening 136, about two-thirds the diameter of the inlet opening 136, about one-half the diameter of the inlet opening 136, about one-third the diameter of the inlet opening 136, or about one-quarter the diameter of the inlet opening 136. As used herein, the term "about" means within ±5% of a referenced value. It should be appreciated, however, that the relative sizes of the inlet opening 136 and the outlet opening 138 are not limited to the listed example fractional relationships, but can likewise reside somewhere between any two of the listed relationships (e.g., the diameter of the outlet opening 138 can be larger than one-quarter the diameter of the inlet opening 136, but smaller than one-third the diameter of the inlet opening 136, and the like). It is also contemplated herein that in some example aspects, the diameter of the outlet opening 138 may be approximately the same as the diameter of the inlet opening 136. Any and all aspects, and any dimensionally intermediate and/or extended variations thereof, are contemplated as being within the scope of aspects contemplated herein.

As further shown in FIG. 1, the outlet opening 138 is positioned a predefined distance inwardly from the inlet opening 136. In example aspects, the outlet opening 138 may be positioned from about 4 cm to about 25 cm inwardly from the inlet opening 136 as measured from the center of the inlet opening 136 to the center of the outlet opening 138. To describe this in a different way, the outlet opening 138 may be positioned to extend inwardly about one-fifth of the width of the pocket structure 116 as measured from, for instance, the outer opening edge 120 to the rear edge 128 (i.e., the edge opposite the outer opening edge 120), about one-fourth of the width of the pocket structure 116, about one-third of the width of the pocket structure 116, about one-half of the width of the pocket structure 116, or about three-quarters of the width of the pocket structure 116. By maintaining a space between the outlet opening 138 and the rear edge 128, items that are passed through the outlet opening 138 have sufficient room to fall into the space 132. Any and all aspects, and any variation thereof, are contemplated as being within aspects herein.

Continuing, in example aspects, the funnel-shaped structure 134 further comprises a first edge 418 that slopes downwardly from a first upper end of the inlet opening 136 to a first upper end of the outlet opening 138. As well, the funnel-shaped structure 134 comprises a second edge 420 that slopes upwardly from a second lower end of the inlet opening 136 to a second lower end of the outlet opening 138. Said differently, the first and second edges 418 and 420 generally converge toward one another when extending from the inlet opening 136 to the outlet opening 138. In the aspect shown in FIG. 1, the first edge 418 and the second edge 420 may comprise generally equal lengths causing the outlet opening 138 to be positioned at a location corresponding generally to an approximate midpoint between the first upper end of the inlet opening 136 and the second lower end of the inlet opening 136. More particularly, due to this positioning of the outlet opening 138, the funnel-shaped structure 134 may be generally symmetrical with respect to a hypothetical line that extends between a center of the inlet opening 136 and a center of the outlet opening 138. It is also contemplated herein that the first edge 418 and the second edge 420 may comprise unequal lengths thereby changing the orientation/angle of the outlet opening 138 relative to the inlet opening 136. This will be explained more fully with respect to FIG. 9.

In example aspects, the funnel-shaped structure 134 may be free-floating within the space 132. That is, besides the inlet opening edge 137 being joined to or extending from the outer opening edge 120 and the inner opening edge 124, the funnel-shaped structure 134 may not comprise any additional attachment points/areas with the outer pocket layer 118 and the inner pocket layer. In other example aspects, the funnel-shaped structure 134 may comprise one or more tether structures that extend from the funnel-shaped structure 134 to one or more of the outer pocket layer 118 and the inner pocket layer, or to a seam joining the outer pocket layer with the inner pocket layer. Examples of tether structures and their function will be provided below.

The pocket structure 116 shown in FIG. 1 additionally depicts an example item 140 in the form of a phone stowed within the pocket structure 116 (shown in dashed line to indicate it is generally hidden from view). The item 140 may comprise any item configured to be stowed within a pocket such as, for example, a phone, a wallet, keys, an ID card, ear buds, and the like. Because the funnel-shaped structure 134 is generally free-floating within the space 132, once the item 140 is deposited in the space 132, the item 140 may move into the space formed between the outer pocket layer 118 and the inner pocket layer, the space between the front of the funnel-shaped structure 134 and the outer pocket layer 118, or the space between the back of the funnel-shaped structure 134 and the inner pocket layer. Further, because of the relatively small circumference of the outlet opening 138, the item 140 is generally prevented from re-entering the outlet opening 138 absent a purposeful action by the wearer thus helping to securely stow the item 140 within the pocket structure 116 and preventing inadvertent departure of the item from the pocket structure 116.

Although not shown, it is contemplated herein that some type of releasable closure mechanism such as hook-and-loop fasteners and/or magnetic closure systems may be used to further secure the opening to the pocket structure 116. These closure systems may help in keeping the opening to the pocket structure 116 closed when not in use but separate easily when a wearer pushes her hand through the inlet opening 136. In one example, one or more pairs of complementary magnets, or hook-and-loop fasteners, may be positioned proximate the outlet opening 138 of the funnel-shaped structure 134, with the complementary portions of the magnet pair(s) or hook-and-loop fasteners positioned on opposing sides of the outlet opening 138 (e.g., one magnet fixed to a side of the funnel-shaped structure 134 proximate the inner pocket layer, and a complimentary magnet fixed to a side of the funnel-shaped structure 134 proximate the outer pocket layer 118), such that the magnets attract one another and couple together, and hold the outlet opening 138 in a flattened, 'closed' state. However, when a hand or other object is inserted into the pocket structure 116 through the funnel-shaped structure 134, the magnets are easily forced apart, allowing entry of the inserted object into the pocket structure 116. When the hand is withdrawn, the magnets will once again attract one another and couple together, automatically 'closing' the outlet opening 138. Although hook-and-loop fasteners do not attract one another from a distance in the same way as magnets, it is expected that relaxation of the funnel-shaped structure 134 upon withdrawal of an object from the pocket structure 116 will bring the opposing complimentary hook and loop portions of the hook-and-loop fastener into contact with one another, wherein a connection will be formed therebetween. As a suitable alternative to two complimentary magnets, a magnet may be paired with a button, a plate, a bead, or other structure including a magnetically attractive material (e.g., a ferrous material, etc.). Such magnetic and/or hook-and-loop closure systems can be likewise or alternatively positioned at the outlet opening 138, at the inlet opening 136, and/or at any point between the outlet opening 138 and the inlet opening 136, to couple together and hold the funnel-shaped structure 134 in a closed state whenever a hand of other object is not being pushed into or remaining within the funnel-shaped structure 134.

Figure 2:
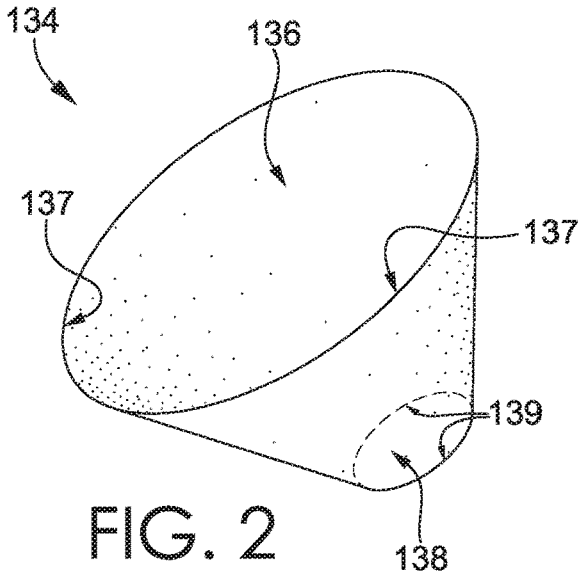
FIG. 2 illustrates a front perspective view of a funnel-shaped structure used in the pocket structure of FIG. 1 in accordance with aspects herein.
Figure 3:
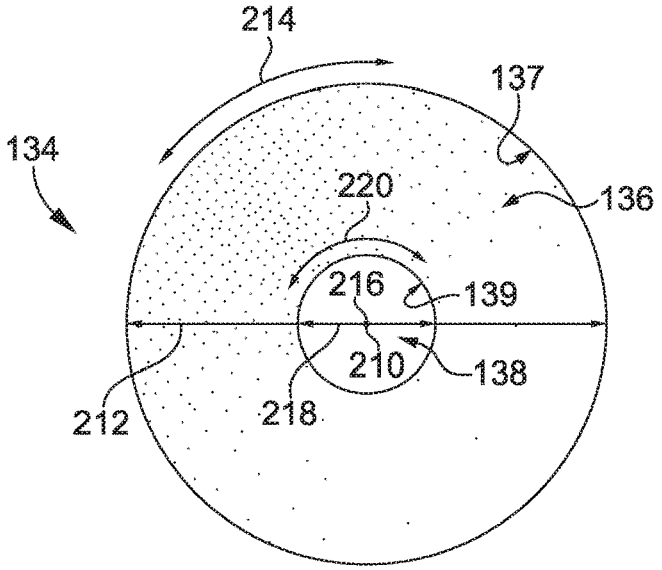
FIG. 3 illustrates a front view of the funnel-shaped structure of FIG. 2 in accordance with aspects herein.
Figure 4:
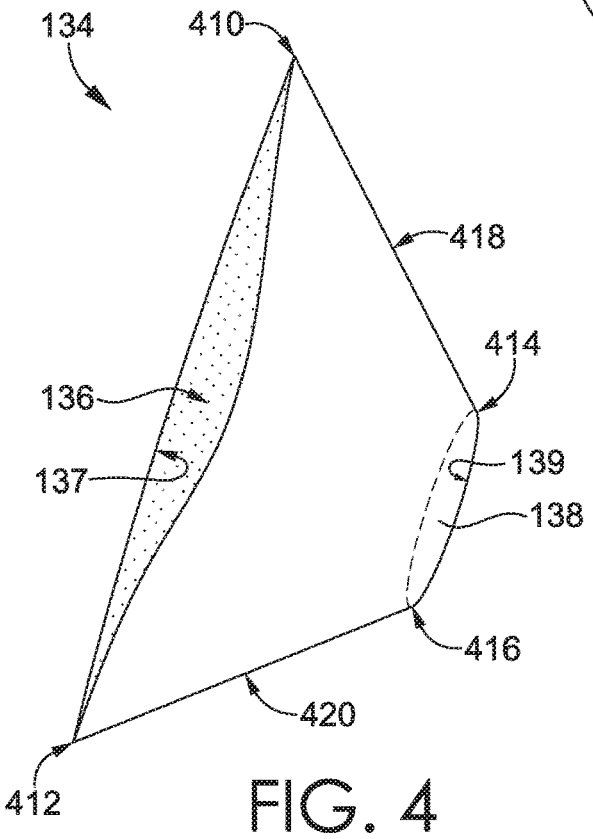
FIG. 4 illustrates a side view of the funnel-shaped structure of FIG. 2 with the funnel-shaped structure in a generally flattened state in accordance with aspects herein.

Turning now to FIGS. 2-4, a front perspective view, a front view, and a side view respectively of the funnel-shaped structure 134 are illustrated in accordance herein. FIGS. 2 and 3 illustrate the funnel-shaped structure 134 in a deformed state to better illustrate certain features of the funnel-shaped structure 134. That is, FIGS. 2 and 3 illustrate the funnel-shaped structure 134 deformed to a somewhat conical shape. FIG. 4 illustrates the funnel-shaped structure 134 in a generally flattened state (i.e., non-deformed state) similar to how it would be incorporated into an article such as the garment 100. It is contemplated herein that the funnel-shaped structure 134 may comprise a single piece of material formed into a somewhat conical shape and secured with a single seam. In other aspects, the funnel-shaped structure 134 may be formed from two or more pieces of material that are joined together at two or more seams. As stated above, it is contemplated herein that the funnel-shaped structure 134, or portions thereof, may be formed from an elastically resilient material. When formed of two or more pieces of material, it is contemplated herein that at least one of the pieces of material may be elastically resilient while other pieces of material may be non-elastic. For instance, a panel of material forming the front of the funnel-shaped structure 134 may be elastically resilient while a panel of material forming the back of the funnel-shaped structure 134 may be non-elastic, or vice versa. It is also contemplated herein, that all the pieces of material are elastically resilient or that all pieces of material are non-elastic.

First with respect to FIG. 2, the funnel-shaped structure 134 comprises the inlet opening edge 137 that circumscribes and/or defines the inlet opening 136. When in a deformed state, and as further shown in FIG. 3, the inlet opening 136 generally comprises a circle with a center 210, a diameter 212, and a circumference 214. Although shown as a circle, it is contemplated herein that the shape defined by the inlet opening edge 137 may comprise other shapes such as an oval, an ellipse, and the like.

Continuing with respect to FIGS. 2 and 3, the funnel-shaped structure 134 further comprises the outlet opening edge 139 that circumscribes and/or defines the outlet opening 138. When in a deformed state, and as further shown in FIG. 3, the outlet opening 138 generally comprises a circle with a center 216, a diameter 218, and a circumference 220. It is contemplated herein that the shape of the outlet opening 138 may mirror the shape of the inlet opening 136 so that if the inlet opening 136 is circular in shape, the outlet opening 138 is also circular in shape, but it is also contemplated herein that the shape of the outlet opening 138 may differ from the shape of the inlet opening 136. As shown in FIG. 3 and as described above, the diameter 212 and circumference 214 of the inlet opening 136 is greater than the diameter 218 and circumference 220 of the outlet opening 138. In example aspects, the diameter 218 of the outlet opening 138 may be about three-quarters the diameter 212 of the inlet opening 136, about two-thirds the diameter 212 of the inlet opening 136, about one-half the diameter 212 of the inlet opening 136, about one-third the diameter 212 of the inlet opening 136, about one-quarter the diameter 212 of the inlet opening 136, and the like.

FIG. 4 illustrates a side view of the funnel-shaped structure 134 in a generally flattened state similar to how the funnel-shaped structure 134 would be incorporated into the pocket structure 116. When in a flattened state, the inlet opening 136 of the funnel-shaped structure 134 has a first upper end 410 and a second lower end 412. Similarly, the outlet opening 138 has a first upper end 414 and a second lower end 416. The funnel-shaped structure 134 additionally comprises the first edge 418 that slopes downwardly from the first upper end 410 of the inlet opening 136 to the first upper end 414 of the outlet opening 138. As well, the funnel-shaped structure 134 comprises the second edge 420 that slopes upwardly from the second lower end 412 of the inlet opening 136 to the second lower end 416 of the outlet opening 138. As stated above, in example aspects, the first edge 418 may comprise the same length as the second edge 420 causing the funnel-shaped structure 134 to be generally symmetrical with respect to a hypothetical axis extending from the center 210 of the inlet opening 136 to the center 216 of the outlet opening 138. Although the first edge 418 and the second edge 420 are shown as generally straight, it is contemplated herein that the first edge 418 and/or the second edge 420 may be curved (convexly or concavely with respect to the hypothetical axis). Any and all aspects, and any variation thereof, are contemplated as being within aspects herein.

Figure 5:
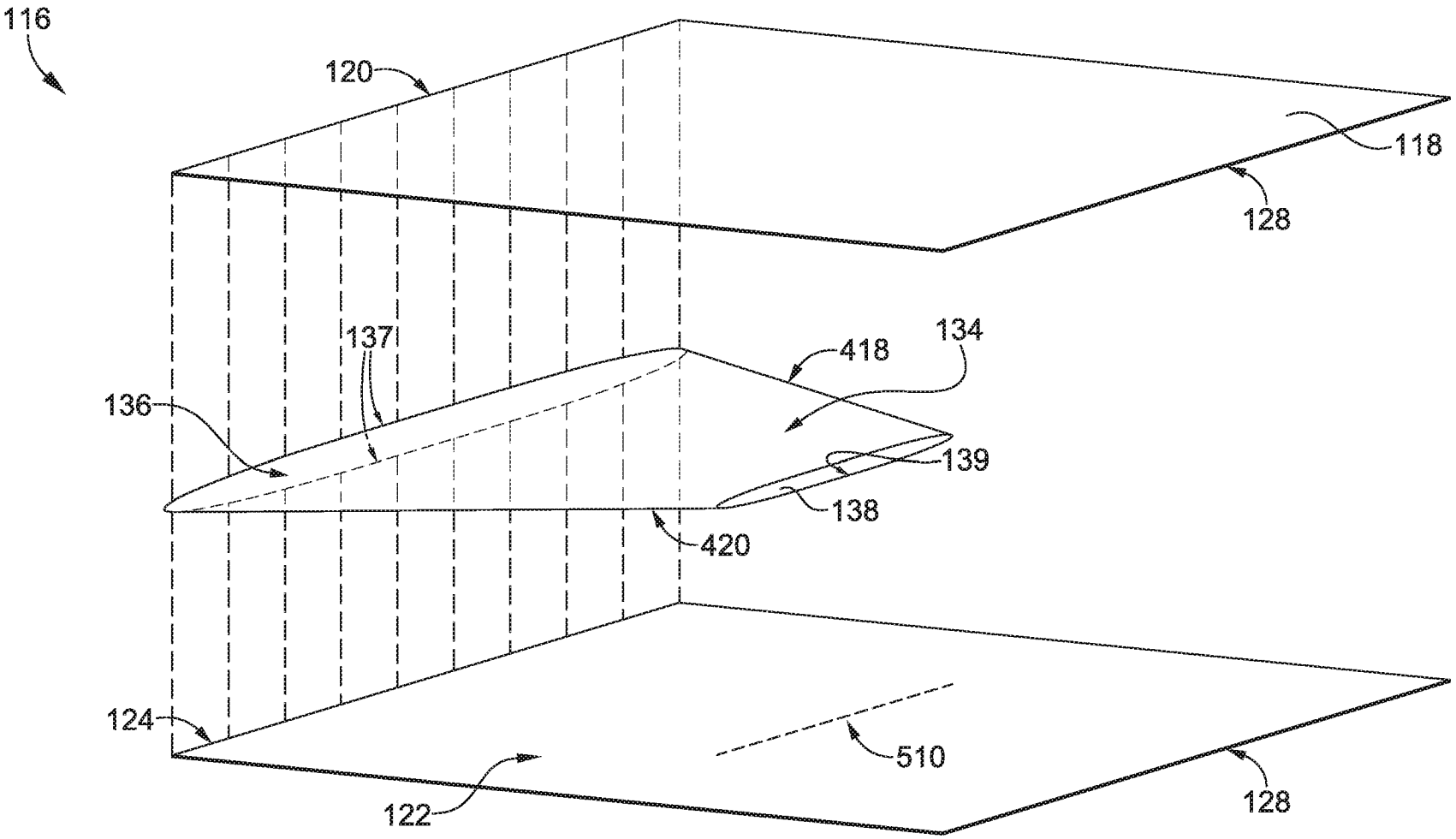
FIG. 5 illustrates an example method of forming the pocket structure of FIG. 1 in accordance with aspects herein.

FIG. 5 illustrates an example method of construction of the pocket structure 116 in accordance with aspects herein. The outer pocket layer 118 is shown with the outer opening edge 120. The inner pocket layer is denoted by reference numeral 122 and includes the inner opening edge 124. In an example aspect, when the pocket structure 116 is located on an exterior aspect of the garment 100, the inner pocket layer 122 may comprise an integral extension of the material forming the torso portion 110 of the garment 100 and the inner opening edge 124 may comprise a demarcation line defining where the outer opening edge 120 is positioned on the garment 100. In an example aspect, when the pocket structure 116 is located on the exterior aspect of the garment 100, the outer pocket layer 118 may comprise a separate material piece layered external to the inner pocket layer 122. As well, the funnel-shaped structure 134 is depicted with its inlet opening 136 defined by the inlet opening edge 137 and the outlet opening 138 defined by the outlet opening edge 139.

In an example method of construction, the front side of the inlet opening edge 137 is joined to the outer opening edge 120, and the back side of the inlet opening edge 137 is joined to the inner opening edge 124 as shown by the dashed lines. Joining technologies may comprise, for example, stitching, bonding, welding, adhesives and the like. In example aspects, the front side of the inlet opening edge 137 may be joined to the outer opening edge 120 along the entire length of the outer opening edge 120, and the back side of the inlet opening edge 137 may be joined to the inner opening edge 124 along the entire length of the inner opening edge 124. The result of this construction is that the inlet opening 136 of the funnel-shaped structure 134 becomes the opening to the pocket structure 116. When the funnel-shaped structure 134 is formed with the inner pocket layer 122 and the outer pocket layer 118 during a single knitting or weaving event, the inlet opening edge 137 may integrally extend from the outer opening edge 120 and the inner opening edge 124.

Continuing, in one example aspect, it is contemplated herein that the first and second edges 418 and 420, and the outlet opening edge 139 of the funnel-shaped structure 134 may remain unaffixed or detached from the outer and inner pocket layers 118 and 122 so that the funnel-shaped structure 134 is detached from or unaffixed from the outer and inner pocket layers 118 and 122 except for its connection to the outer opening edge 120 and the inner opening edge 124. In other example aspects, one or more tether structures may be used to at least partially attach the funnel-shaped structure 134 to the inner pocket layer 122, or the outer pocket layer 118, or at a junction (e.g., seam) between the inner pocket layer 122 and the outer pocket layers 118, to help prevent the funnel-shaped structure 134 from everting when, or from remaining everted after, a wearer withdraws her hand from the inlet opening 136.

With further respect to FIG. 5, reference numeral 510 denotes a hypothetical line indicating how far inwardly the funnel-shaped structure 134 extends into the pocket structure 116. As seen, it is contemplated herein that outlet opening 138 is spaced from the rear edge 128 of the pocket structure 116 to allow for any items inserted through the outlet opening 138 to drop into the space 132. The location of the line 510 is an example only, and it is contemplated herein that the line 510 may be located closer to the inlet opening 136 or closer to the rear edge 128 of the pocket structure 116.

Figure 6:
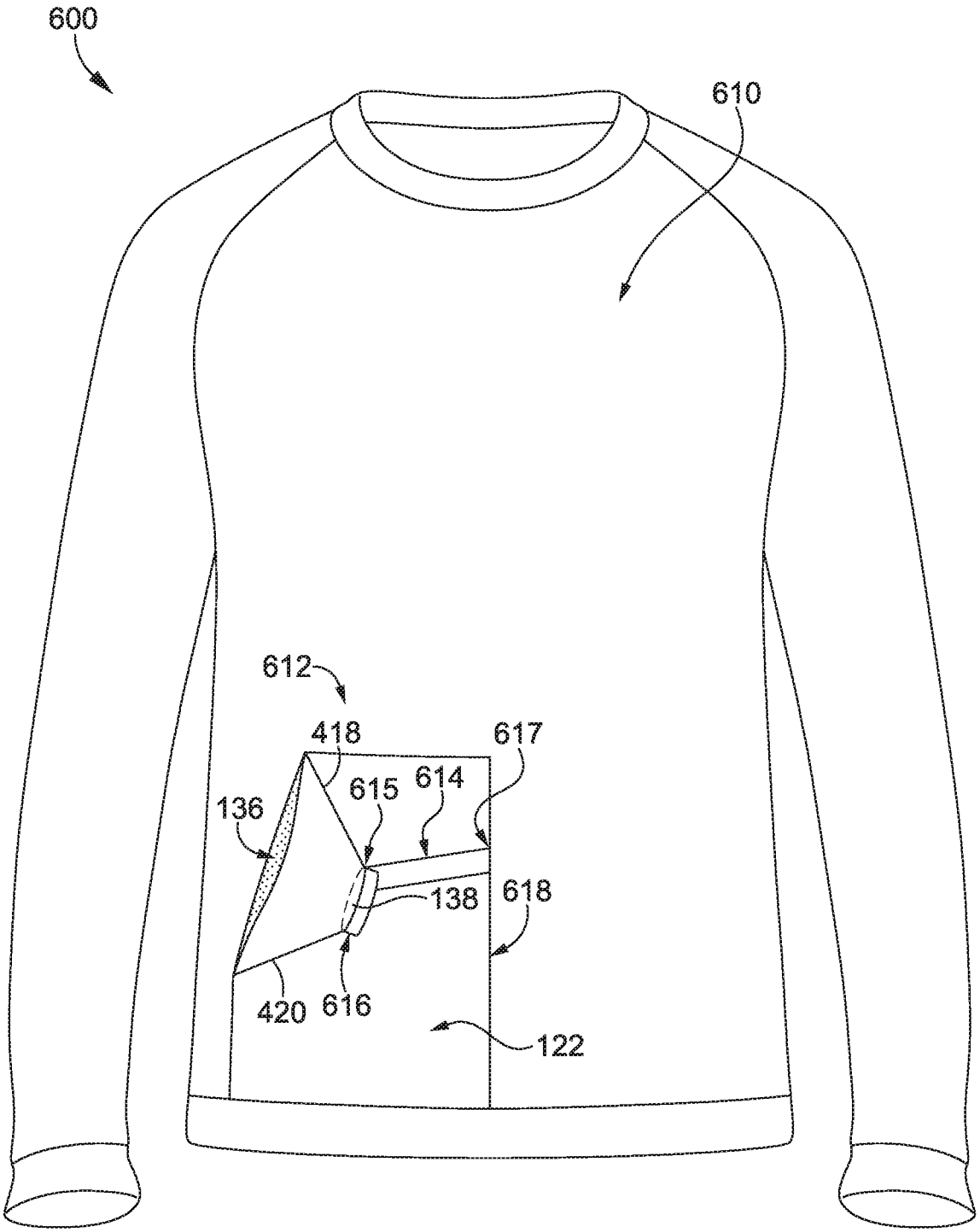
FIG. 6 illustrates a front view of an upper-body garment having a pocket structure that further includes a tether structure in accordance with aspects herein.

Turning to FIG. 6, a front view of an article in the form of an upper-body garment 600 is depicted in accordance with aspects herein. Similar to the garment 100, the garment 600 includes a pocket structure 612 on a front aspect of a torso portion 610 where the pocket structure 612 is generally the same as the pocket structure 116 except for the use of an example tether structure 614 and the use of an elastic band 616 surrounding the outlet opening 138. Because of the similarity between the pocket structure 612 and the pocket structure 116, the same reference numerals will be used to describe common features. The pocket structure 612 is shown with the outer pocket layer 118 removed to better illustrate the described features but with the lines indicating the points of attachment of the edges of the outer pocket layer 118 to the upper-body garment 600 remaining.

With respect to FIG. 6, aspects herein contemplate the use of the tether structure 614 where the tether structure 614 is affixed at a first end 615 to the outlet opening 138 of the funnel-shaped structure 134 and at a second end 617 to a rear edge 618 of the pocket structure 612, or an area adjacent to the rear edge 618, using affixing technologies such as stitching, bonding, welding, adhesives, and the like. The tether structure 614 may comprise a strap, a cord, a band, or the like and may further exhibit elastic properties. More particularly, the second end 617 of the tether structure 614 may be attached to the inner pocket layer 122 at or adjacent the rear edge 618 of the pocket structure 612, the outer pocket layer 118 at or adjacent the rear edge 618 of the pocket structure 612, or to a seam line connecting the inner pocket layer 122 to the outer pocket layer 118 at the rear edge 618 of the pocket structure 612. As shown, the second end 617 of the tether structure 614 is positioned inwardly from the first end 615 of the tether structure 614. To describe this differently, the second end 617 of the tether structure 614 is positioned farther away from the inlet opening 136 compared to the first end 615 of the tether structure 614. Although the first end 615 of the tether structure 614 is shown attached to the outlet opening 138, it is contemplated herein that the first end 615 of the tether structure 614 may be attached to the first edge 418 and/or the second edge 420 at areas adjacent (e.g., within ±5 cm) to the outlet opening 138. As well, although the second end 617 of the tether structure 614 is shown attached to the rear edge 618, the second end 617 may be attached to the inner pocket layer 122 and/or the outer pocket layer 118 at other locations than that shown in FIG. 6. Use of the tether structure 614 helps to prevent the funnel-shaped structure 134 from everting, or from remaining everted, when a wearer withdraws her hand (with or without an item) through the outlet opening 138 and subsequently through the inlet opening 136.

It is also contemplated herein, that the funnel-shaped structure 134 may comprise an optional elastic band 616 circumscribing the outlet opening 138. The elastic band 616 may help constrict the outlet opening 138 when not in use to further secure any items stowed within the pocket structure 612. Moreover, the elastic band 616 may cause the material adjacent to the outlet opening 138 to pucker or gather when in a resting state thus providing sufficient material to enable expansion of the outlet opening 138 from about 1.25 to about 5.0 times larger than its relaxed diameter, or more, when an item is inserted or withdrawn through the outlet opening 138.

Figure 7:
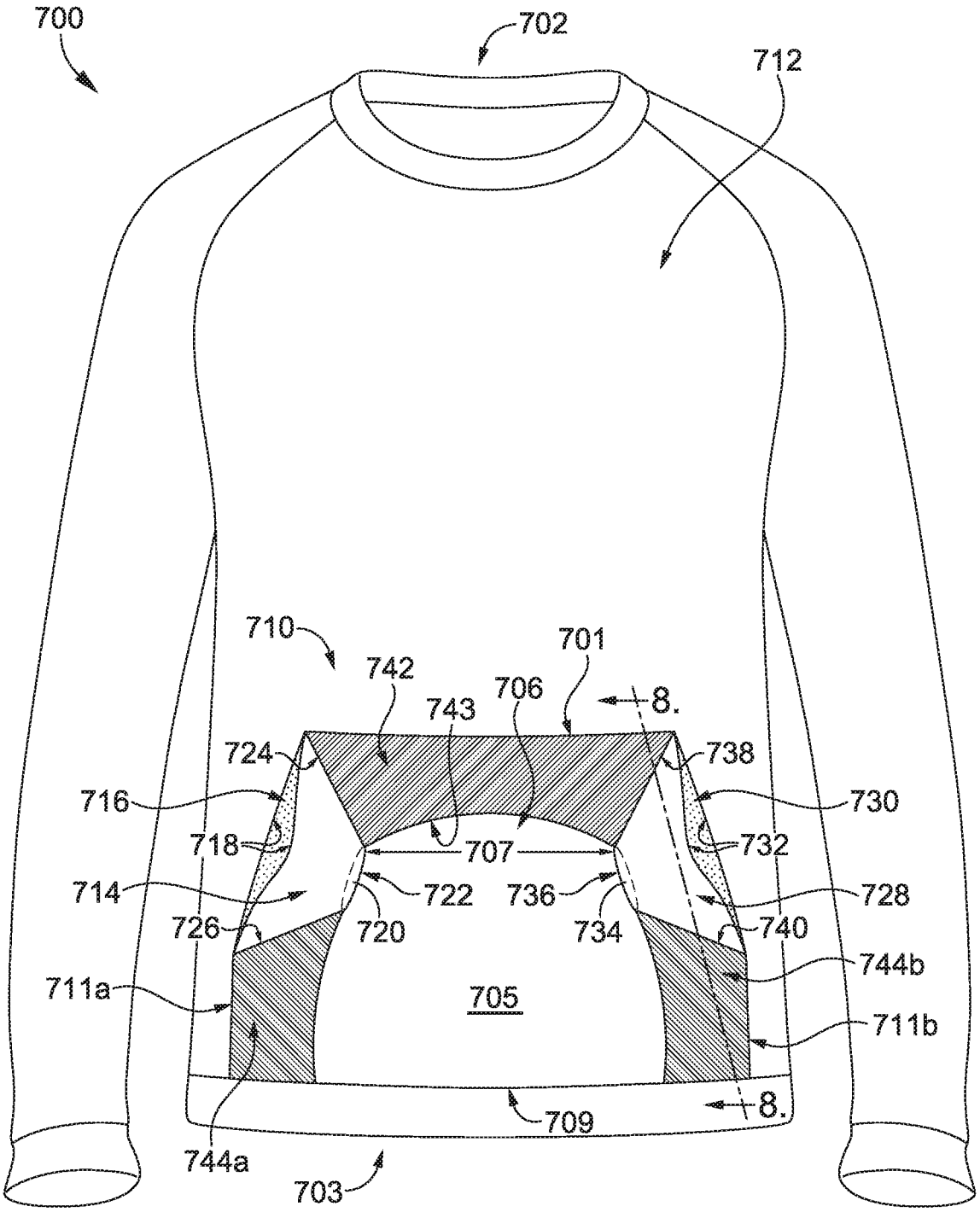
FIG. 7 illustrates a front view of an upper-body garment having a pocket structure that includes two funnel-shaped structures and tether structures in accordance with aspects herein.

Turning to FIG. 7, a front view of an article in the form of an upper-body garment 700 is depicted in accordance with aspects herein. The upper-body garment 700 is in the form of a pullover with a "kangaroo" style pocket structure 710 located on a lower, front aspect of a torso portion 712 of the garment 700. In example aspects, the torso portion 712 defines at least a neck opening 702 and a waist opening 703. As is known in the art, a kangaroo pocket has openings on either side enabling a wearer to insert a right hand in one pocket opening and a left hand in the other pocket opening. The pocket structure 710 is depicted with the outer pocket layer removed to better illustrate features described herein.

The pocket structure 710 comprises an upper edge 701, a lower edge 709, and side edges 711*a* and 711*b*. It is contemplated herein that the pocket structure 710 may comprise other similar shape configurations. For instance, the pocket structure 710 may not comprise the side edges 711*a* and 711*b* such that the lower end of the pocket opening is positioned adjacent to the waist opening 703. Continuing, the pocket structure 710 further comprises an inner pocket layer 705 and an outer pocket layer (not shown) that define a space 706 therebetween. In example aspects, the outer pocket layer may be joined to the inner pocket layer 705 along the upper edge 701, the lower edge 709, and the side edges 711*a* and 711*b* using affixing technologies known in the art. The pocket structure 710 additionally comprises a first funnel-shaped structure 714 having an inlet opening 716 defined by an inlet opening edge 718 and an outlet opening 720 defined by an outlet opening edge 722 where the outlet opening 720 is in communication with the space 706 formed between the outer pocket layer and the inner pocket layer 705. The inlet opening 716 of the first funnel-shaped structure 714 forms a first opening to the pocket structure 710. The first funnel-shaped structure 714 further comprises a first edge 724 and a second edge 726 that approach each other or converge toward each other as they extend from the inlet opening 716 to the outlet opening 720.

Continuing, the pocket structure 710 also comprises a second funnel-shaped structure 728 positioned opposite the first funnel-shaped structure 714. The second funnel-shaped structure 728 has an inlet opening 730 defined by an inlet opening edge 732 and an outlet opening 734 defined by an outlet opening edge 736 where the outlet opening 734 is also in communication with the space 706 formed between the outer pocket layer and the inner pocket layer 705. The inlet opening 730 of the second funnel-shaped structure 728 forms a second opening to the pocket structure 710. The second funnel-shaped structure 728 further comprises a first edge 738 and a second edge 740 that approach each other or converge toward each other as they extend from the inlet opening 730 to the outlet opening 734. It is contemplated herein that the outlet opening 720 of the first funnel-shaped structure 714 is separated from the outlet opening 734 of the second funnel-shaped structure 728 by a distance 707. In example aspects, the distance 707 may be from about 5 cm to about 30 cm although smaller and greater distances are contemplated herein. By spacing apart the outlet openings 720 and 734, items inserted through either opening may have sufficient room to fall into the space 706. Additional features associated with the first and second funnel-shaped structures 714 and 728 are similar to those described for the funnel-shaped structure 134 and as such will not be repeated for brevity sake.

The pocket structure 710 additionally comprises a first tether structure 742 shown with positively sloped cross-hatching. In example aspects, the first tether structure 742 comprises a continuous piece of material that, at its upper end extends along the upper edge 701 of the pocket structure 710, and at its lower end is affixed to the first and second funnel-shaped structures 714 and 728. For instance, the first tether structure 742 is affixed at its lower end to the first edge 724 of the first funnel-shaped structure 714 and the first edge 738 of the second funnel-shaped structure 728, and is affixed at its upper end to one or more of the inner pocket layer 705 adjacent the upper edge 701, the outer pocket layer adjacent the upper edge 701, or at the seam line that forms the upper edge 701 of the pocket structure 710. In one example aspect, the first tether structure 742 may be affixed to the first edge 724 of the first funnel-shaped structure 714 and the first edge 738 of the second funnel-shaped structure 728 along an entire length of the respective first edges 724 and 738. In another example aspect, the first tether structure 742 may be affixed to a portion of the first edge 724 of the first funnel-shaped structure 714 adjacent the outlet opening 720 and a portion of the first edge 738 of the second funnel-shaped structure 728 adjacent the outlet opening 734.

Continuing, in example aspects, the first tether structure 742 further comprises a free edge 743 at its lower end where the free edge 743 extends between the upper end of the outlet opening 720 of the first funnel-shaped structure 714 and the upper end of the outlet opening 734 of the second funnel-shaped structure 728. In example aspects, the free edge 743 may have a slight upwardly curved shape as shown. In other example aspects, the free edge 743 may be more linear. Further, in example aspects, the free edge 743 may be secured (e.g., tacked) to the outer pocket layer and/or the inner pocket layer 705 at some point between the outlet opening 720 and the outlet opening 734. Any and all aspects, and any variation thereof, are contemplated as being within aspects herein.

In aspects, the first tether structure 742 may be formed from an elastically resilient material to allow the first and second funnel-shaped structures 714 and 728 to evert slightly when, for instance, a wearer withdraws her hand (with or without an item) from the pocket structure 710, but then to bias the first and second funnel-shaped structures 714 and 728 back into the pocket structure 710 causing them to return to their resting location. It is also contemplated herein that the first tether structure 742 may be formed of a non-elastically resilient material. It is further contemplated herein that the material used to form the first tether structure 742 may be lightweight and pliable to improve the aesthetics and comfort of the pocket structure 710.

The pocket structure 710 may additionally comprise an optional second tether structure shown with negatively sloped cross-hatching. In one example aspect, the second tether structure may comprise two separate tether structures including a second tether structure 744*a* and a second tether structure 744*b*. The second tether structure 744*a* is affixed at its upper end to the second edge 726 of the first funnel-shaped structure 714 and is further affixed at its lower end to one or more of the inner pocket layer 705 adjacent the side edge 711*a* of the pocket structure 710 and/or adjacent the lower edge 709 of the pocket structure 710; the outer pocket layer adjacent the side edge 711*a* of the pocket structure 710 and/or adjacent the lower edge 709 of the pocket structure 710; and/or the seam line that forms the side edge 711*a* and/or the lower edge 709 of the pocket structure 710. And the second tether structure 744*b* is affixed at its upper end to the second edge 740 of the second funnel-shaped structure 728 and is further affixed at its lower end to one or more of the inner pocket layer 705 adjacent the side edge 711*b* of the pocket structure 710 and/or adjacent the lower edge 709 of the pocket structure 710; the outer pocket layer adjacent the side edge 711*b* of the pocket structure 710 and/or adjacent the lower edge 709 of the pocket structure 710; and/or the seam line that forms the side edge 711*b* and/or the lower edge 709 of the pocket structure 710. It is further contemplated herein that the second tether structures 744*a* and 744*b* may be affixed to the second edges 726 and 740 respectively along an entire length of the respective second edges 726 and 740 or to a portion of the second edges 726 and 740 adjacent to the outlet openings 720 and 734 respectively.

Continuing, similar to the first tether structure 742, the second tether structures 744*a* and 744*b* may be formed of an elastically resilient, thin, pliable material although non-elastically resilient materials are also contemplated herein. In example aspects, the second tether structure may comprise a configuration similar to the first tether structure 742 in that it may comprise a continuous piece of material that extends the width of the lower edge 709 of the pocket structure 710. It is also contemplated herein that the first tether structure 742 may be optional and for the pocket structure 710 to comprise just the second tether structure 744*a* and 744*b*. As stated, it is also contemplated herein that the second tether structure may be optional and for the pocket structure 710 to comprise just the first tether structure 742. It is still further contemplated that the pocket structure 710 comprise both the first tether structure 742 and the second tether structure 744*a* and 744*b*. In yet another aspect, the pocket structure 710 may comprise a tether structure that is affixed at its first end to the outlet opening 720 of the first funnel-shaped structure 714 and at its second end to the outlet opening 734 of the second funnel-shaped structure 728 such that it extends directly across the pocket structure 710 between the outlet openings 720 and 734 (i.e., spans the distance 707). Any and all aspects, and any variation thereof, are contemplated as being within aspects herein.

When both the first tether structure 742 and the second tether structure 744*a* and 744*b* are used, the elastic nature of the tether structures 742, 744*a*, and 744*b* may act to exert tension on the upper end and lower end respectively of the outlet openings 720 and 734 when in a resting state. This tension may facilitate keeping the outlet openings 720 and 734 in a flattened or closed state further securing items stowed within the pocket structure 710.

Figure 8:
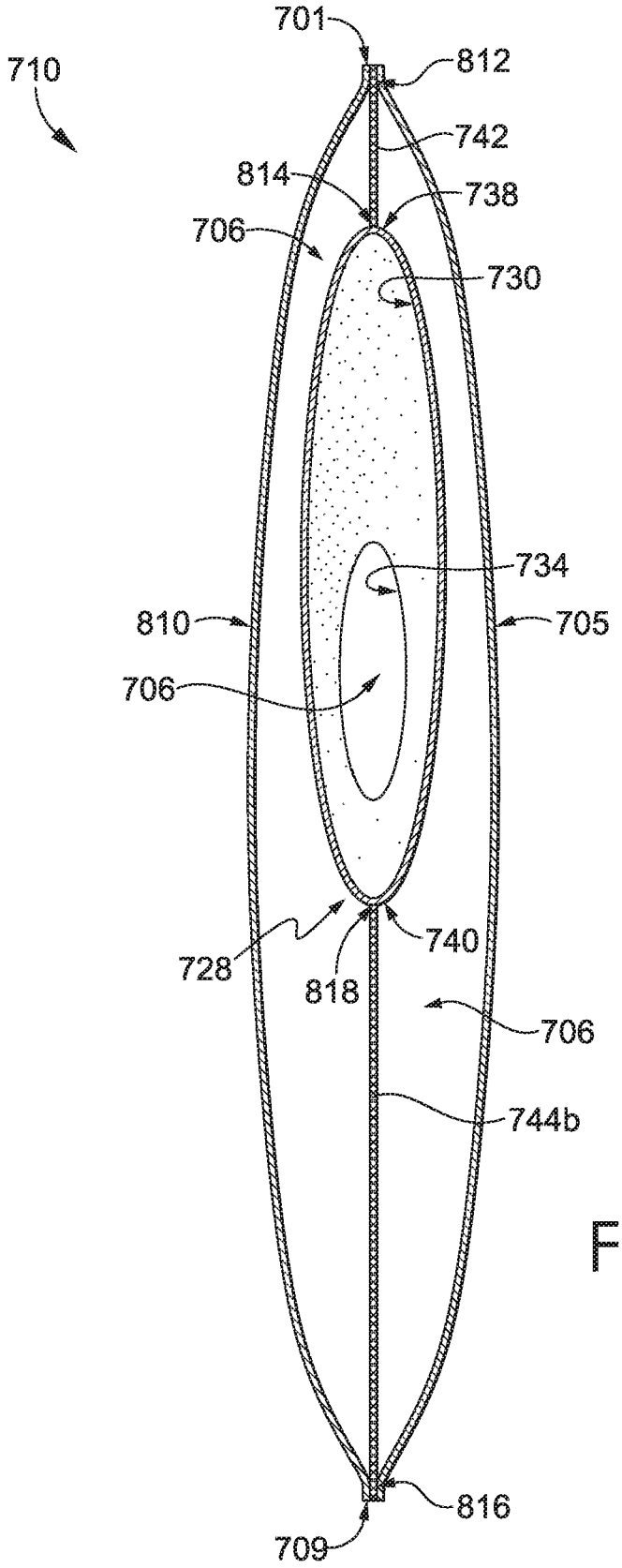
FIG. 8 illustrates a cross-sectional view taken along cut line 8-8 of FIG. 7 in accordance with aspects herein.

FIG. 8 depicts an example cross-section of the pocket structure 710 taken along cut line 8-8 of FIG. 7 in accordance with aspects herein. FIG. 8 is depicted with the outer pocket layer now referenced by numeral 810. With respect to FIG. 8, a connection point between the upper end of the first tether structure 742 and the upper edge 701 of the pocket structure 710 is indicated by reference numeral 812, and a connection point between the lower end of the first tether structure 742 and the first edge 738 of the second funnel-shaped structure 728 is indicated by reference numeral 814. As well, a connection point between the lower end of the second tether structure 744*b* and the lower edge 709 of the pocket structure 710 is indicated by reference numeral 816, and a connection point between the upper end of the second tether structure 744*b* and the second edge 740 of the second funnel-shaped structure 728 is indicated by reference numeral 818. A cross-section of the pocket structure 710 that cuts through the first funnel-shaped structure 714 would be similar.

FIG. 8 is also provided to help illustrate the extent of the space 706 formed between the outer pocket layer 810 and the inner pocket layer 705 into which items deposited in the pocket structure 710 may reside. Besides the space 706 shown in FIG. 7, the space 706 further extends between a front side of the second funnel-shaped structure 728 and the outer pocket layer 810, a front side of the first tether structure 742 and the outer pocket layer 810, and a front side of the second tether structure 744*b* and the outer pocket layer 810. The space 706 further extends between a back side of the second funnel-shaped structure 728 and the outer pocket layer 810, a back side of the first tether structure 742 and the outer pocket layer 810, and a back side of the second tether structure 744*b* and the outer pocket layer 810.

Figure 9:
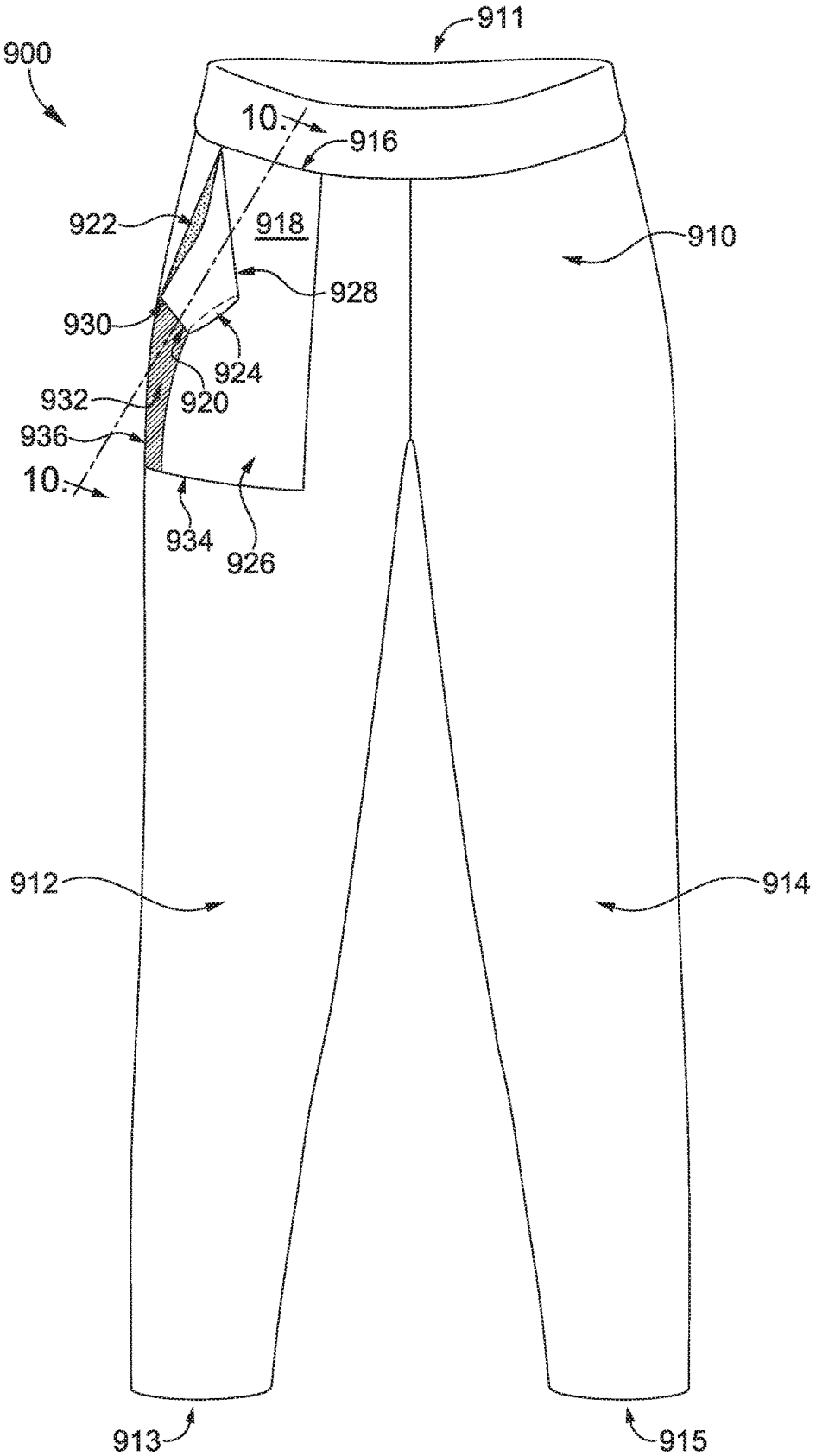
FIG. 9 illustrates a lower-body garment with a pocket structure in accordance with aspects herein.

Although aspects herein have mainly related to pocket structures located on an upper-body garment, it is contemplated herein that the pocket structure may also be located on lower-body garments such as the lower-body garment 900 shown in FIG. 9 in accordance with aspects herein. The lower-body garment 900 comprises a torso portion 910 defining a waist opening 911 configured to encircle a waist area of a wearer, a first leg portion 912 defining a first leg opening 913 where the first leg portion 912 is configured to cover, at least partially, a leg of a wearer, and a second leg portion 914 defining a second leg opening 915 where the second leg portion 914 is configured to cover, at least partially, the other leg of the wearer. The lower-body garment 900 is shown in the form of a pant although it is contemplated herein that it may take other forms such as shorts, tights, capris, and the like. The lower-body garment 900 further comprises a pocket structure 916 positioned on a front aspect of the torso portion 910. This location is illustrative only, and it is contemplated herein that the pocket structure 916 may be located at other areas on the lower-body garment 900.

The pocket structure 916 comprise a structure somewhat similar to the pocket structure 116 of the upper-body garment 100. For instance, the pocket structure 916 comprises an outer pocket layer (removed to better illustrate features described herein), an inner pocket layer 918, and a funnel-shaped structure 920. The funnel-shaped structure 920 comprises an inlet opening 922 that forms an opening to the pocket structure 916 and an outlet opening 924 in communication with a space 926 formed between the outer pocket layer and the inner pocket layer 918. The funnel-shaped structure 920 further comprises a first edge 928 extending from an upper end of the inlet opening 922 to an upper end of the outlet opening 924, and a second edge 930 extending from a lower end of the inlet opening 922 to a lower end of the outlet opening 924. The pocket structure 916 further comprises a tether structure 932 that is affixed at its upper end to the second edge 930 of the funnel-shaped structure 920 and is further affixed to, for instance, a side seam 936 of the lower-body garment 900 (i.e., a seam connecting, for instance, a front panel to a back panel of the lower-body garment 900) and/or a lower edge 934 of the pocket structure 916.

FIG. 9 illustrates an example aspect where the funnel-shaped structure 920 may not be symmetrical with respect to a hypothetical axis that extends between a center of the inlet opening 922 and a center of the outlet opening 924 due to the first edge 928 having a longer length than the second edge 930. This causes the outlet opening 924 to be positioned medially and inferior to the inlet opening 922. This positioning of the outlet opening 924 may be suitable for pockets having a longer vertical length as opposed to horizontal width. In example aspects, the length of the first and second edges of the funnel-shaped structure may be adjusted to position the outlet opening in a desired position for a specific pocket configuration. For instance, the length of the first edge 928 may be shorter than the length of the second edge 930 to cause the outlet opening 924 to be positioned medially and superior to the inlet opening 922. Or, as shown above, the length of the first and second edges may be generally equal to cause the outlet opening to be positioned medially and approximately midway between upper and lower ends of the inlet opening 922. Any and all aspects, and any variation thereof, are contemplated as being within the scope herein.

Figure 10:
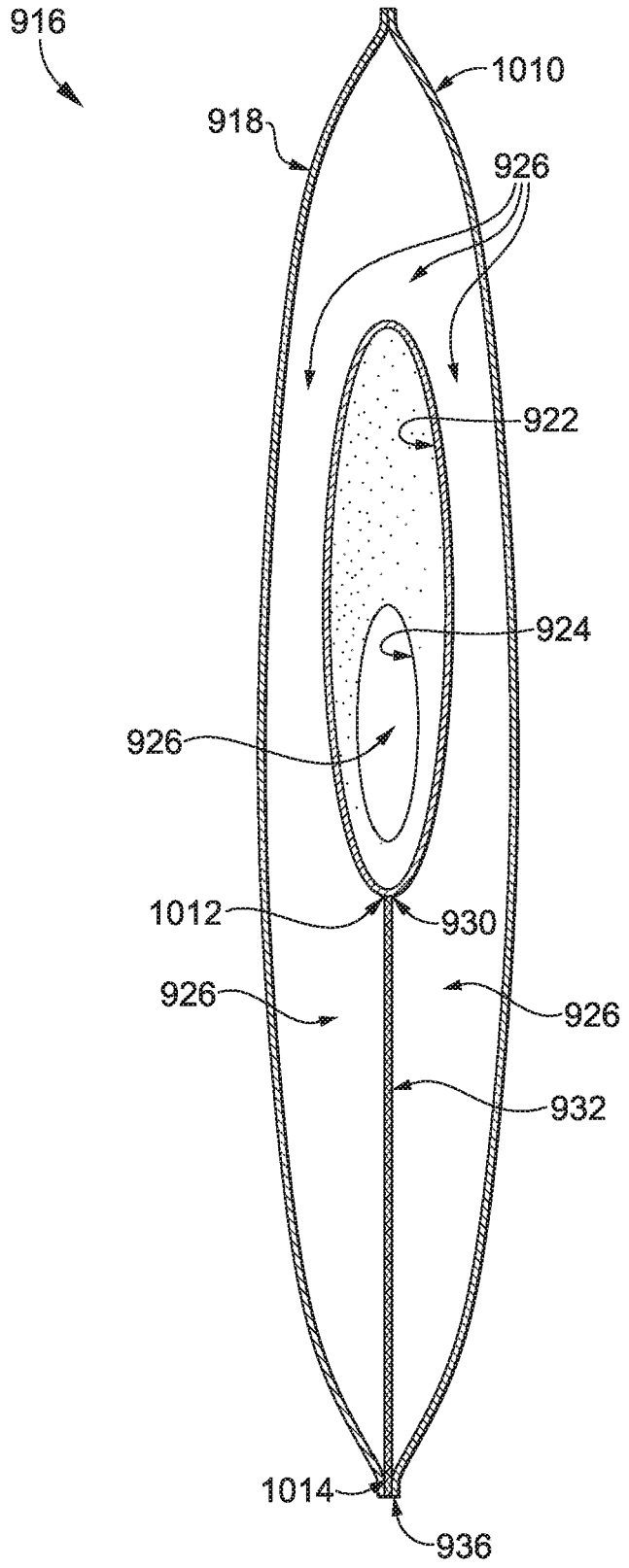
FIG. 10 illustrates a cross-sectional view taken along cut line 10-10 of FIG. 9 in accordance with aspects herein.

FIG. 10 illustrates a cross-sectional view taken along cut line 10-10 of FIG. 9 in accordance with aspects herein. FIG. 10 is depicted with the outer pocket layer now referenced by numeral 1010. With respect to FIG. 10, a connection point between the upper end of the tether structure 932 and the second edge 930 of the funnel-shaped structure 920 is indicated by reference numeral 1012, and a connection point between the tether structure 932 and the side seam 936 is indicated by reference numeral 1014. Besides the space 926 shown in FIG. 9, the space 926 further extends between a front side of the funnel-shaped structure 920 and the outer pocket layer 1010, and a back side of the funnel-shaped structure 920 and the inner pocket layer 918. The space 926 further extends between a front side of the tether structure 932 and the outer pocket layer 1010 (stopping at, for instance, the side seam 936) and a back side of the tether structure 932 and the inner pocket layer 918 (stopping at, for instance, the side seam 936). As illustrated, there are multiple different spaces in which an item may reside after being deposited in the pocket structure 916 via the outlet opening 924. And the particular space in which an item resides may be dependent upon a particular orientation of the lower-body garment 900 (e.g., wearer laying down on his side, his back, his front; wearer standing up, wearer sitting, etc.). In any instance, due to the presence of the multiple spaces and due to the outlet opening 924 having a smaller diameter than the inlet opening 922, the chances of the item escaping the pocket structure 916 absent a purposeful removal by the wearer are minimized.

Although not shown, it is further contemplated that the pocket structures described herein may be incorporated into non-garment articles such as backpacks, duffel bags, and the like.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1. A pocket structure for an article, the pocket structure comprising:

an outer pocket layer comprising an outer opening edge;

an inner pocket layer comprising an inner opening edge, the outer pocket layer and the inner pocket layer defining a space therebetween; and a funnel-shaped structure having an inlet opening defined by an inlet opening edge and an outlet opening opposite the inlet opening that is defined by an outlet opening edge, the inlet opening having a greater circumference than the outlet opening, wherein:

the funnel-shaped structure is positioned in the space between the outer pocket layer and the inner pocket layer, and the inlet opening edge of the funnel-shaped structure extends from the outer opening edge of the outer pocket layer and the inner opening edge of the inner pocket layer.

Clause 2. The pocket structure of clause 1, further comprising an elastic band circumscribing the outlet opening.

Clause 3. The pocket structure of any of clauses 1 through 2, wherein the funnel-shaped structure is formed from an elastically resilient material.

Clause 4. The pocket structure of any of clauses 1 through 3, wherein the inlet opening edge of the funnel-shaped structure extends from the outer opening edge of the outer pocket layer along an entire length of the outer opening edge.

Clause 5. The pocket structure of any of clauses 1 through 4, wherein the inlet opening edge of the funnel-shaped structure further extends from the inner opening edge of the inner pocket layer along an entire length of the inner opening edge.

Clause 6. The pocket structure of any of clauses 1 through 5, wherein the inlet opening edge of the funnel-shaped structure, the outer opening edge of the outer pocket layer, and the inner opening edge of the inner pocket layer cooperate to form an opening to the space between the outer pocket layer and the inner pocket layer.

Clause 7. The pocket structure of any of clauses 1 through 6, wherein when the funnel-shaped structure is in a flattened state, the funnel-shaped structure comprises a first edge extending from an upper end of the inlet opening to an upper end of the outlet opening and a second edge extending from a lower end of the inlet opening to lower end of the outlet opening.

Clause 8. The pocket structure of clause 7, further comprising a first tether structure extending from the first edge of the funnel-shaped structure to one or more of the outer pocket layer and the inner pocket layer.

Clause 9. The pocket structure of any of clauses 7 through 8, further comprising a second tether structure extending from the second edge of the funnel-shaped structure to one or more of the outer pocket layer and the inner pocket layer.

Clause 10. An article comprising:

a pocket structure located at a predetermined location on the article, the pocket structure comprising:

an outer pocket layer comprising at least an outer opening edge;

an inner pocket layer comprising at least an inner opening edge, the outer pocket layer and the inner pocket layer defining a space therebetween; and a funnel-shaped structure having an inlet opening defined by an inlet opening edge and an outlet opening opposite the inlet opening that is defined by an outlet opening edge, the inlet opening having a greater circumference than the outlet opening, wherein:

the funnel-shaped structure is positioned in the space between the outer pocket layer and the inner pocket layer, and the inlet opening edge of the funnel-shaped structure extends from the outer opening edge of the outer pocket layer and the inner opening edge of the inner pocket layer.

Clause 11. The article of clause 10, wherein the article comprises an upper-body garment.

Clause 12. The article of any of clauses 10 through 11, wherein the pocket structure is located at a lower front aspect of the upper-body garment.

Clause 13. The article of clause 10, wherein the article comprises a lower-body garment.

Clause 14. The article of any of clauses 10 through 13, wherein one or more of the outer pocket layer, the inner pocket layer, and the funnel-shaped structure are formed from an elastically resilient material.

Clause 15. The article of any of clauses 10 through 14, wherein the pocket structure further comprises at least one tether structure extending from an area at or adjacent the outlet opening to one or more of the outer pocket layer, the inner pocket layer, and a seam joining the outer pocket layer and the inner pocket layer.

Clause 16. The article of any of clauses 10 through 15, wherein the outlet opening of the funnel-shaped structure is spaced apart from the inlet opening by a predefined amount.

Clause 17. The article of any of clauses 10 through 16, wherein the outer opening edge of the outer pocket layer, the inner opening edge of the inner pocket layer, and the inlet opening edge of the funnel-shaped structure cooperate to form an opening to the space formed between the outer pocket layer and the inner pocket layer.

Clause 18. A pocket structure for an article, the pocket structure comprising:

an outer pocket layer comprising at least an outer opening edge;

an inner pocket layer comprising at least an inner opening edge, the outer pocket layer and the inner pocket layer defining a space therebetween;

a funnel-shaped structure having an inlet opening defined by an inlet opening edge and an outlet opening opposite the inlet opening that is defined by an outlet opening edge, the inlet opening having a greater circumference than the outlet opening, wherein:

the funnel-shaped structure is positioned in the space between the outer pocket layer and the inner pocket layer, the inlet opening edge of the funnel-shaped structure extends from the outer opening edge of the outer pocket layer along an entire length of the outer opening edge, and wherein the inlet opening edge of the funnel-shaped structure further extends from the inner opening edge of the inner pocket layer along an entire length of the inner opening edge, the inlet opening edge, the outer opening edge, and the inner opening edge cooperate to form an opening to the space between the outer pocket layer and the inner pocket layer; and a tether structure that extends from an area adjacent the outlet opening of the funnel-shaped structure to one or more of the outer pocket layer, the inner pocket layer, and a seam joining the outer pocket layer and the inner pocket layer.

Clause 19. The pocket structure of clause 18, wherein the inlet opening edge of the funnel-shaped structure integrally extends from the outer opening edge and the inner opening edge.

Clause 20. The pocket structure of clause 18, wherein the inlet opening edge is affixed to the outer opening edge of the outer pocket panel and the inner opening edge of the inner pocket panel through one or more of stitching, adhesives, and bonding.

Clause 21. A pocket structure comprising:

an inner pocket layer;

an outer pocket layer, the inner pocket layer and the outer pocket layer defining a space therebetween; and a funnel-shaped structure positioned in the space between the inner pocket layer and the outer pocket layer, the funnel-shaped structure comprising an inlet opening that forms the opening to the pocket structure, and an outlet opening that is in communication with the space between the inner pocket layer and the outer pocket layer, the outlet opening having a smaller circumference than the inlet opening.

Clause 22. The pocket structure of clause 21, further comprising a tether structure extending from the funnel-shaped structure to one or more of the inner pocket layer and the outer pocket layer.

Clause 23. The pocket structure of any of clauses 21 through 22, wherein the outlet opening is expandable.

Clause 24. The pocket structure of any of clauses 21 through 23, wherein the funnel-shaped structure is formed from an elastically resilient material.

Clause 25. The pocket structure of any of clauses 21 through 24, further comprising a first releasable closure mechanism positioned on a first side of the outlet opening and a second releasable closure mechanism positioned on an opposite side of the outlet opening.

Clause 26. The pocket structure of clause 25, wherein the first releasable closure mechanism is complementary to the second releasable closure mechanism.

Clause 27. The pocket structure of any of clauses 25 through 26, wherein the first releasable closure mechanism and the second releasable closure mechanism comprise complementary magnets.

Clause 28. The pocket structure of any of clauses 25 through 26, wherein the first releasable closure mechanism comprises a loop component of a hook-and-loop fastener system, and wherein the second releasable closure mechanism comprises a hook component of the hook-and-loop fastener system.

Clause 29. The pocket structure of any of clauses 25 through 26, wherein the first releasable closure mechanism comprises a hook component of a hook-and-loop fastener system, and wherein the second releasable closure mechanism comprises a loop component of the hook-and-loop fastener system.

Clause 30. The pocket structure of any of clauses 21 through 29, further comprising a first releasable closure mechanism positioned on a first side of the inlet opening and a second releasable closure mechanism positioned on an opposite side of the inlet opening.

Clause 31. The pocket structure of clause 30, wherein the first releasable closure mechanism is complementary to the second releasable closure mechanism.

Clause 32. The pocket structure of any of clauses 30 through 31, wherein the first releasable closure mechanism and the second releasable closure mechanism comprise complementary magnets.

Clause 33. The pocket structure of any of clauses 30 through 31, wherein the first releasable closure mechanism comprises a loop component of a hook-and-loop fastener system, and wherein the second releasable closure mechanism comprises a hook component of the hook-and-loop fastener system.

Clause 34. The pocket structure of any of clauses 30 through 31, wherein the first releasable closure mechanism comprises a hook component of a hook-and-loop fastener system, and wherein the second releasable closure mechanism comprises a loop component of the hook-and-loop fastener system.

Clause 35. The pocket structure of clauses 21 through 24, further comprising a first releasable closure mechanism positioned on a first side of the outlet opening and a second releasable closure mechanism complementary to the first releasable closure mechanism positioned on a second opposite side of the outlet opening, and further comprising a third releasable closure mechanism positioned on a first side of the inlet opening and a fourth releasable closure mechanism complementary to the third releasable closure mechanism positioned on a second opposite side of the inlet opening.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A pocket structure for a garment, the pocket structure comprising:

an inner pocket layer comprising an inner opening edge;

an outer pocket layer comprising an outer opening edge, the outer pocket layer and the inner pocket layer defining a pocket space therebetween;

a first tapered channel structure positioned in the pocket space between the outer pocket layer and the inner pocket layer, the first tapered channel structure having an inlet opening defined by an inlet opening edge and an outlet opening opposite the inlet opening that is defined by an outlet opening edge, the first tapered channel structure providing a passageway to the pocket space from the inlet opening edge to the outlet opening edge; and a first tether structure extending inwardly from the tapered channel structure and secured to one or more of the outer pocket layer, the inner pocket layer, and a seam joining the outer pocket layer and the inner pocket layer, inwardly of the outlet opening.

2. The pocket structure of claim 1, wherein the first tether structure is continuous with the first tapered channel structure.

3. The pocket structure of claim 1, wherein the outlet opening edge of the first tapered channel structure is held in a spaced relationship from the inlet opening edge by the first tether structure.

4. The pocket structure of claim 1, wherein the first tapered channel structure comprises a top edge and a bottom edge, wherein each of the top edge and the bottom edge extends from the inlet opening edge to the outlet opening edge of the first tapered channel structure.

5. The pocket structure of claim 4, wherein the first tether structure extends from the top edge of the first tapered channel structure to one or more of the outer pocket layer, the inner pocket layer, and a seam joining the outer pocket layer and the inner pocket layer.

6. The pocket structure of claim 4, wherein the first tether structure extends from the bottom edge of the first tapered channel structure to one or more of the outer pocket layer, the inner pocket layer, and a seam joining the outer pocket layer and the inner pocket layer.

7. The pocket structure of claim 5, further comprising a second tether structure.

8. The pocket structure of claim 7, wherein the second tether structure extends from the bottom edge of the first tapered channel structure to one or more of the outer pocket layer, the inner pocket layer, and a seam joining the outer pocket layer and the inner pocket layer.

9. A pocket structure for a garment, the pocket structure comprising:

an inner pocket layer;

an outer pocket layer, the outer pocket layer and the inner pocket layer defining a pocket space therebetween;

wherein the inner and outer pocket layers are coupled to one another around a periphery of the pocket space except at least at a first entry opening disposed at a first edge of the pocket structure;

a first pocket entry structure disposed between the inner and outer pocket layers and extending from an inlet opening disposed at the first entry opening to an outlet opening disposed inwardly within the pocket space relative to the inlet opening, the first pocket entry structure being funnel shaped and having a first funnel edge extending from the inlet opening to the outlet opening and having a second funnel edge spaced apart from the first funnel edge and extending from the inlet opening to the outlet opening, the first funnel edge and the second funnel edge converging toward one another in a direction from the inlet opening toward the outlet opening;

wherein the inlet opening has a first length along the first edge of the first entry opening and the outlet opening has a second length between the first funnel edge and the second funnel edge, wherein the first length is greater than the second length;

wherein the outlet opening is suspended within the pocket space between the inner pocket layer and the outer pocket layer; and at least a first tether extending from the first funnel edge in a first direction away from the first pocket entry structure, wherein the first tether comprises a first floating edge coupled with and extending along the first funnel edge; a first anchored edge extending along a portion of the periphery of the pocket space and coupled with one of the inner pocket layer, the outer pocket layer, and a seam joining the inner pocket layer and the outer pocket layer; and a first inwardmost edge aligned with and extending from the outlet opening, the first inwardmost edge defining an arc oriented concavely downward.

10. The pocket structure of claim 9, wherein the first pocket entry structure comprises:

an inner funnel layer comprising an expanse extending from the inlet opening to the outlet opening, and further extending from the first funnel edge to the second funnel edge; and an outer funnel layer disposed between the inner funnel layer and the outer pocket layer and comprising an expanse extending from the inlet opening to the outlet opening, and further extending from the first funnel edge to the second funnel edge.

11. The pocket structure of claim 10, wherein either or both of the inner funnel layer and the outer funnel layer comprises an elastically deformable textile.

12. The pocket structure of claim 9, further comprising at least a second tether extending from the second funnel edge in a second direction away from the first pocket entry structure, wherein the second direction is different from the first direction.

13. The pocket structure of claim 12, wherein either or both of the first tether and the second tether comprise an elastically deformable textile.

14. The pocket structure of claim 12, wherein the second tether comprises an expanse having:

a second floating edge coupled with and extending along the second funnel edge;

a second anchored edge extending along a portion of the periphery of the pocket space and coupled with one of the inner pocket layer, the outer pocket layer, and a seam joining the inner pocket layer and the outer pocket layer; and a second inwardmost edge aligned with and extending from the outlet opening, wherein the second inwardmost edge defines an arc orientated concavely inward relative to the inlet opening.

15. The pocket structure of claim 14, wherein the inner and outer pocket layers are coupled to one another around a periphery of the pocket space except at least at the first entry opening and at a second entry opening disposed at a second edge of the pocket structure, the first entry opening being spaced apart from the second entry opening, the pocket structure further comprising a second pocket entry structure disposed between the inner and outer pocket layers and extending from a second inlet opening disposed at the second entry opening to a second outlet opening disposed inwardly within the pocket space relative to the second inlet opening, the second pocket entry structure being spaced apart from the first pocket entry structure, the second pocket entry structure being funnel shaped and having a third funnel edge extending from the second inlet opening to the second outlet opening and having a fourth funnel edge spaced apart from the third funnel edge and extending from the second inlet opening to the second outlet opening, the third funnel edge and the fourth funnel edge converging toward one another in a direction from the second inlet opening toward the second outlet opening;

wherein the second inlet opening has a third length along the second edge of the second entry opening and the second outlet opening has a fourth length between the third funnel edge and the fourth funnel edge, wherein the third length is greater than the fourth length;

wherein the second outlet opening is suspended within the pocket space between the inner pocket layer and the outer pocket layer, spaced apart from the outlet opening of the first pocket entry structure; and wherein the first tether extends from the outlet opening of the first pocket entry structure to the outlet opening of the second pocket entry structure.

16. The pocket structure of claim 15, wherein the first inwardmost edge of the first tether structure extends between the first pocket entry structure and the second pocket entry structure and defines the arc oriented concavely downward.

17. The pocket structure of claim 16, further comprising a third tether extending from the second funnel edge of the second pocket entry structure, the third tether comprising an expanse having:

a third floating edge coupled with and extending along the fourth funnel edge of the second pocket entry structure;

a third anchored edge extending along a portion of the periphery of the pocket space and coupled with one of the inner pocket layer, the outer pocket layer, and a seam joining the inner pocket layer and the outer pocket layer; and a third inwardmost edge aligned with and extending from the outlet opening.

18. The pocket structure of claim 17, wherein the third inwardmost edge defines an arc orientated concavely inward relative to the inlet opening of the second pocket entry structure.

* * * * *